US005727289A

United States Patent [19]

Reder

[11] Patent Number: 5,727,289

[45] Date of Patent: Mar. 17, 1998

[54] HINGE MOUNTED ADJUSTABLE DOOR STOP

[76] Inventor: Andrew Reder, 484 E. Los Angeles Ave., Ste. 108-316, Moorpark, Calif. 93021

[21] Appl. No.: 587,589

[22] Filed: Jan. 17, 1996

[51] Int. Cl.[6] ..... E05D 11/06

[52] U.S. Cl. ..... 16/375; 16/82

[58] Field of Search ..... 16/374, 375, 82; 292/DIG. 12, DIG. 15, DIG. 17, 341.12

[56] References Cited

U.S. PATENT DOCUMENTS

| | | | |
|---|---|---|---|
| 1,481,742 | 1/1924 | Riley . | |
| 1,757,075 | 5/1930 | Earhart . | |
| 1,931,271 | 10/1933 | Simmons | 16/375 |
| 2,055,743 | 9/1936 | Falcone . | |
| 2,237,148 | 4/1941 | Kaptuller . | |
| 2,280,655 | 4/1942 | Madsen . | |
| 2,638,620 | 5/1953 | Civitelli . | |
| 2,660,750 | 12/1953 | Wallen . | |
| 2,813,293 | 11/1957 | Civitelli . | |
| 2,839,779 | 6/1958 | Haag . | |
| 2,990,572 | 7/1961 | Schwartzberg . | |
| 2,993,226 | 7/1961 | Baker, Jr. et al. . | |
| 3,135,012 | 6/1964 | Wessel . | |
| 3,178,762 | 4/1965 | Whiting | 16/375 |
| 3,187,372 | 6/1965 | Parsons . | |
| 3,211,494 | 10/1965 | Husko . | |
| 3,325,854 | 6/1967 | Steigerwald . | |
| 3,488,667 | 1/1970 | Gutshall . | |
| 3,531,824 | 10/1970 | Hagendoorn et al. . | |
| 3,538,539 | 11/1970 | Allison . | |
| 3,602,942 | 9/1971 | Neff, Sr. . | |
| 3,905,064 | 9/1975 | Brockhaus . | |
| 3,911,529 | 10/1975 | Pringle . | |
| 3,913,171 | 10/1975 | Reid . | |
| 4,259,762 | 4/1981 | Civitelli . | |
| 4,831,688 | 5/1989 | Deininger . | |
| 4,998,941 | 3/1991 | Smith . | |
| 5,187,837 | 2/1993 | Gunderson et al. . | |
| 5,237,724 | 8/1993 | Lee . | |
| 5,265,922 | 11/1993 | Falcone | 292/DIG. 12 |
| 5,287,596 | 2/1994 | Chen et al. . | |
| 5,311,644 | 5/1994 | Laforgerie . | |

*Primary Examiner*—Chuck Y. Mah
*Attorney, Agent, or Firm*—Richard D. Slehofer

[57] ABSTRACT

A first and second pair of door stop elements are mounted to an existing door hinge and aligned with the barrels on the door hinge. A pair of barrels have to be cutaway to mount the stops. The hinge pin holds everything in position. One of the pair of door stops is shaped like a metal bar with a pair of knuckles at the top and the bottom. It also has curves, indentations, flat contact points and grooves. The back of the first stop is recessed to provide clearance to avoid the hinge barrels against which the stop is positioned after installation. The flat contact points abut against the faces of the pair of door hinges to prevent the door from opening beyond a fixed point. The fist stop is used alone when the door opens up to 180 degrees. The second stop works with the first stop element and is used to limit the door opening to much less than 180 degrees. The second element is described as an elongated U-shaped bracket. The first element fits inside the second element. Both elements pivot freely about the hinge pin. The second element has a pair of screws to adjust and limit the opening angle of the door. Variants of the invention are elongated versions of the first and second stop elements. The variants fit at the top and bottom of a conventional door hinge. An elongated hinge pin and a nut are necessary to mount the elongated version to the pair of door hinges.

7 Claims, 4 Drawing Sheets

HINGE MOUNTED ADJUSTABLE DOOR STOP

CROSS REFERENCE TO RELATED APPLICATIONS none

BACKGROUND OF THE INVENTION

1. Field of the Invention

The present invention pertains to the following areas of technology.

MISCELLANEOUS HARDWARE

Hinge: including sliding surfaces to permit relative translation of hinged members; and stop or abutment for pivotal movement.

Hinge: having plural hinge axes (e.g., multiple pintle); including stop or latch.

2. Description of the Prior Art

U.S. Pat. No. 2,990,572 issued Jul. 4, 1961 to Schwartzberg discloses a hinge structure with a stop member limiting the angle of opening of the hinge.

SUMMARY AND OPERATION OF THE INVENTION

The present invention is a pair of stop elements that can be mounted to an existing door hinge to limit the maximum opening of the door. Limitations on the opening of doors are useful to prevent the door and door knob from damaging an adjacent wall, nearby appliances or furniture. The present invention is designed to be mounted to the door hinge by means of the door hinge pin. A conventional pair of door hinge leafs have five barrels aligned axially. The pin is inserted through the barrels to hold the door in place and also to allow the door to swing open and to close about the pivot point where the hinge pin is located. The first component of the present invention is a first stop element, which is shaped like a metal bar with a pair of knuckles at the top and the bottom. The lower portion of the second barrel on one of the door hinges must be partially cut away to allow the bottom knuckle to slide into place to be axially aligned with the hinge pin. The first stop element has a recessed area in its back portion to allow the first stop element to be positioned over the first and second barrels of the door hinge. The same hinge pin is then reinserted through the barrels and the present invention. The present invention will prevent the door from opening beyond 180 degrees from its closed position. The first stop element has a left vertical beveled edge and a right beveled blade head. These two edges abut themselves between the faces of the pair of hinge leafs. The hinge pin maintains the first stop element in position and the left beveled edge and the right blade head abut against the pair of hinge leafs at a certain rotation. If someone attempts to open the door further, the first stop element will prevent this, because the first stop element is made of a hard metal, and the hinge leafs are also made of metal.

The second component, which is called the second stop element is complementary with the first stop element. The second element also has a pair of arms for axial alignment with the hinge pin. The second stop element slips over the first element so that the pair work together. The second element has a pair of adjustment screws to adjust the maximum opening angle for the door from about 20 degrees to about 180 degrees. The second element has a channel to avoid the beveled head on the first stop element. The beveled head on the first stop element is disabled when the second stop element is used. The second stop element also has a vertical beveled edge that can abut against the active door hinge leaf. The two adjustment screws in the second stop element cause the angle between the two abutment edges to change. By changing the angle, the limitation on the maximum angle that the door can be opened can be adjusted to reduce the angle to 90 degrees if that is the limitation desired.

The pair of stop elements can be elongated to fit over all of the barrels on the pair of hinge leafs. In this way, one of the barrels does not have to be shortened. A longer hinge pin is then needed along with a threaded tip and a nut to hold the pair of elements in place. The number of adjustment screws on the second stop element can be increased from two to four or even six.

The first stop element can be installed on the door in the upright or inverted position. Additionally the combination of the first and second stop elements can also be installed in the upright or inverted position. The left and right side edges function interchangeably when stopping the door. Instructions will indicate the proper installation method. The installer, however, can make a mistake or not read the instructions. In this event the inverted mounting of the elements will still allow the present invention to work properly.

DETAILED DESCRIPTION OF THE PREFERRED EMBODIMENT

Figure 8:
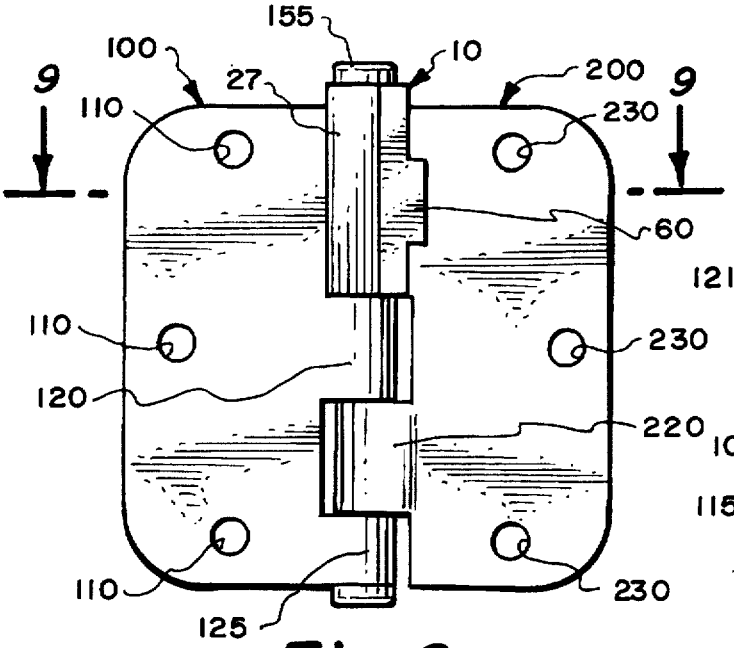
FIG. 8 is a front elevational view of the first door stop element component of the present invention mounted to the pair of leaf hinges of a door that swings open 180 degrees relative to the wall in which the door is hung.
Figure 9:
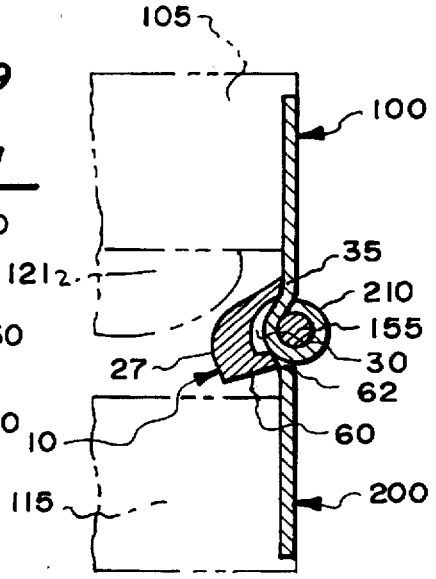
FIG. 9 is a transverse sectional view taken along the line 9—9 of FIG. 8, showing the door jam, molding and door in broken lines when the door is open.
Figure 10:
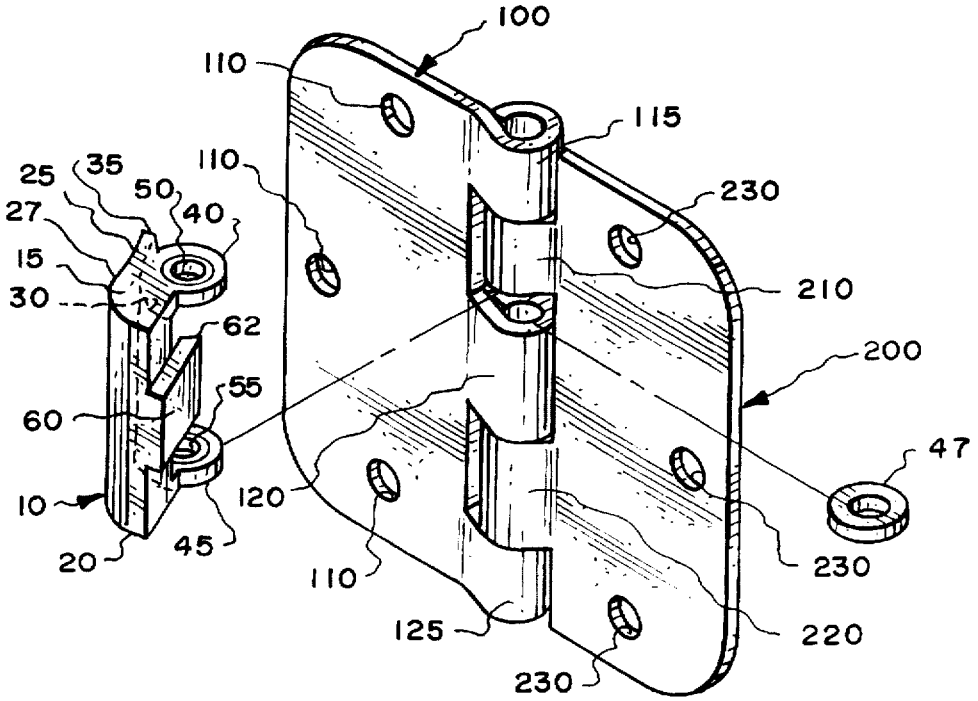
FIG. 10 is a perspective view of the first stop element when used by itself in combination with a pair of leaf hinges.

The present invention will now be discussed in greater detail. In one embodiment, the present invention includes the following components: a first stop element 10, a second stop element 300, a stationary leaf hinge 100, an active leaf hinge 200, a hinge pin 155 and a spacer ring 47. FIGS. 8–10 illustrate the first stop element 10 used as a door stop without the second stop element. The first stop element 10 component of the present invention is mounted to the pair of leaf hinges of a door that is unobstructed and can swing open the full 180 degree range relative to the wall in which the door is hung. Most doors are hung in the same manner. A mortise is cut into the surface of the door jamb 105 where the stationary leaf hinge 100 is secured with wood screws through the screw holes 110. A mortise is also cut into the surface of the edge of the door 115. The active hinge 200 is likewise secured with wood screws through the screw holes 230. Most doors are hung with an upper pair and a lower pair of hinges. The door is then mounted to the door jamb. The barrels 210 and 220 of the active hinge leaf 200 are aligned with the barrels 115, 120, and 125 of the stationary hinge leaf 100. The hinge pin 155 is then inserted through all of the hinge barrels. A door lock and a pair of door knobs are then installed on the door. The hinge pin 155 is a pivot point about which the door can be opened and closed. The pair of hinge leafs 100 and 200 are mounted so that the hinge barrels 115, 210, 120, 220, and 125 are in the room into which the door 115 can open. The door 115 can open only in one direction. This is the result of the mechanical configuration of the hinge leafs relative to the door and the door jamb. FIG. 9 shows the arrangement found where the door jamb 105 and door 115 are hung in a wall forming one side of a room and where there is sufficient clearance to allow the door to be fully opened without hitting an adjacent wall. In the fully opened position, the front of the door 115 is facing the wall and is parallel to the wall. Since the door knob extends from the door, it will be the first part of the door to make contact with the wall when the door is opened, unless the opening door can be stopped just before the door knob makes contact with the wall. Repeated unrestrained openings of the door will allow the door knob to continue to impact the wall and eventually will indent and damage the wall at the point of impact. The present invention is intended to stop the door from opening just before the door knob can impact. The present invention is positioned between the pair of hinge leafs 100 and 200 to stop the angular rotation of the active hinge 200 at a preselected angle between the pivotal pair of hinge leafs 100 and 200 as defined by the dimensions of the first stop element 10.

The first stop element 10 has a top, a bottom, a front, a back, a left side portion, and a right side portion. The first stop element can be described as a bar with various curves, indentations, flat contact points, and grooves. The first stop element is shown in perspective in FIGS. 7 and 10. The first stop element 10 also has a pair of axially aligned spaced apart upper and lower knuckles 40 and 45. The upper knuckle 40 has a hinge pin hole 50, and the lower knuckle 45 has a hinge pin hole 55. Both knuckles 40 and 45 are positioned at the top 15 and the bottom 20 of the first stop element 10. Both knuckles can define the vertical length of the first stop element 10. The first stop element 10 has a generally transversely curved outer surface 27 for avoiding contact with any molding 121 adjacent a door jam where a stationary leaf hinge 100 can be mounted. The back of the first stop element 10 has a vertical concave cavity or recess 30 for providing clearance with the barrel 210 on the active hinge leaf 200. The recess or concave cavity 30 is shown in broken lines in FIG. 7, and the recess or cavity is clearly illustrated in the transverse sectional view of the first stop element in FIG. 9. The drawings show the invention with a left side and a right side relative to the drawing pages. This convention is continued in the description herein. The left side portion of the first stop element has a vertical narrow flat beveled face 35 for abutting against the stationary hinge adjacent to the stationary barrels 115 and 120 while at the same time avoiding contact with the edge of the door jamb or any molding 120 or trim adjacent to a door jamb where the stationary leaf hinge 100 is mounted.

The right side portion of the first stop element 10 has an integral raised blade portion 60 that has the appearance of the end of a flat chisel blade with a beveled head 62 projecting from the back of the first stop element 10 for abutting against the active hinge leaf 200. FIG. 9 shows the head 62 abutting against the active hinge leaf 200, and the face 35 abutting against the stationary hinge 100. The first stop element 10 functions in this manner. It prevents the door 115 from opening beyond the 180 degree range.

The barrel 210 on the active hinge 200 is shorter than the other barrels to provide a small clearance with the top of the adjacent stationary barrel 120. This small clearance allows the bottom knuckle 45 of the first stop element 10 to be placed into the space and positioned in axial alignment with the other barrels. A spacer ring 47 can be positioned between the bottom knuckle 45 and the barrel 120 if desired, or to eliminate any unwanted clearance between the knuckle 45 and the barrel 120.

Figure 7:
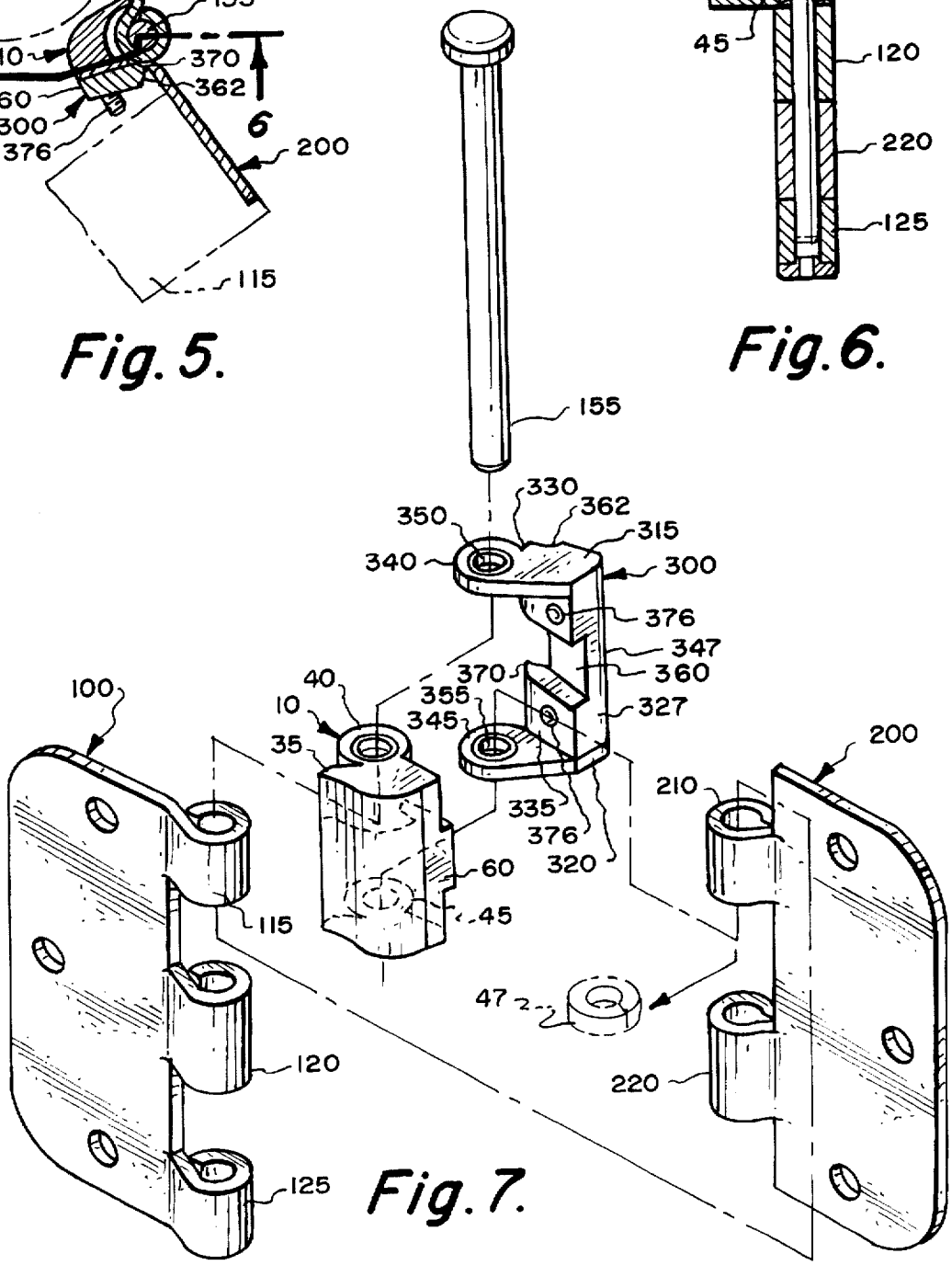
FIG. 7 is exploded view of the present invention showing the pair of door leaf hinges, the hinge pin, the first door stop element, and the complementary second door stop element.

The first stop element is mounted to the pair of hinge leafs 100 and 200 as illustrated in the perspective views in FIGS. 7 and 10. The top knuckle 40 is positioned above the barrel 115. Because of the preselected distance between the top knuckle 40 and the bottom knuckle 45, the bottom knuckle is positioned above the stationary barrel 120. The hinge pin 155 is then inserted through knuckles 40 and 45 and all of the barrels as illustrated in FIG. 8. When the first stop element 10 is used to retrofit existing doors, the bottom of the active barrel 210 must be trimmed away to allow sufficient clearance for the bottom knuckle 45 to be placed into the proper axial position.

FIG. 7 is an exploded view illustrating a conventional left stationary leaf hinge 100, a modified right active leaf hinge 200, a conventional hinge pin 155 or pintle pin, the first stop element 10 and the second stop element 300. The first stop element 10 and the second stop element 300 comprise in combination the present invention. The first stop element 10 can be used without the second stop element 300 when the door 115 is capable of swinging fully open to 180 degrees.

The combination of the first and second stop elements is used when the user has to limit the amount of the opening of the door 115 to less than 180 degrees. Many doors are hung near a corner of the room. In this arrangement, the door knob will hit the adjacent wall unless the opening door is limited by the present invention.

Figure 1:
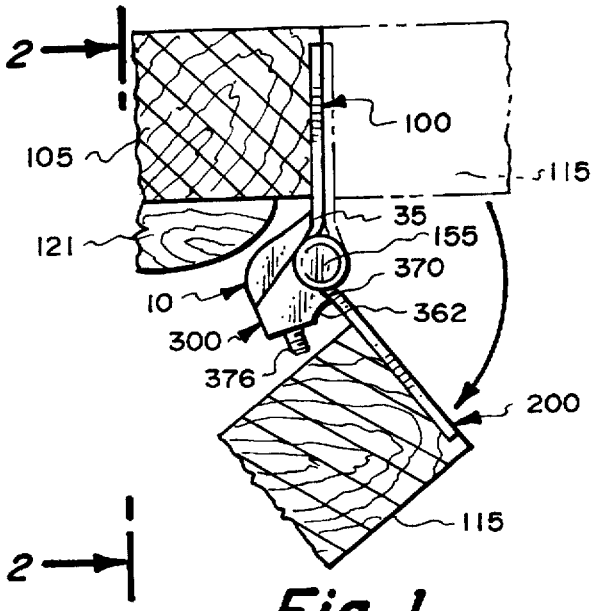
FIG. 1 is a top plan view of the present invention mounted to the pair of leaf hinges and the door and door jamb.
Figure 3:
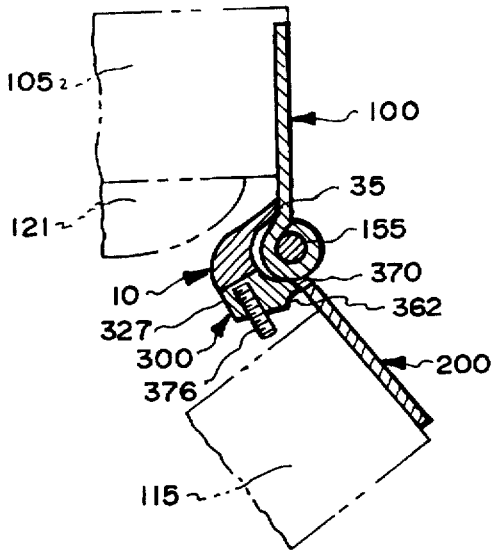
FIG. 3 is a transverse sectional view taken along the line 3—3 in FIG. 2.
Figure 2:
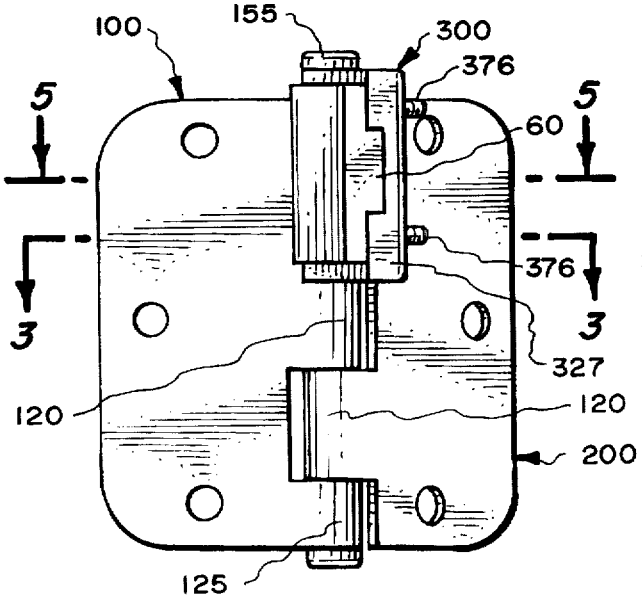
FIG. 2 is a front elevational view taken along the line 2—2 of FIG. 1 and illustrating the present invention mounted to the pair of hinge leaves by the pintle pin.
Figure 4:
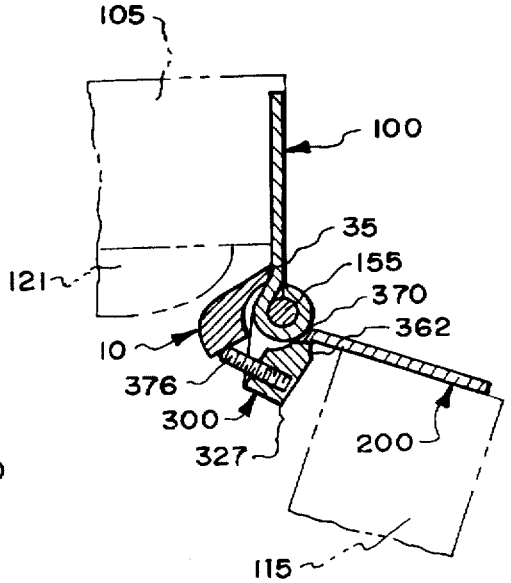
FIG. 4 is a transverse sectional view similar to FIG. 3 showing the spacer element and the bracket separating as the door is closing, taken along the line 5—5 of FIG. 2.
Figure 5:
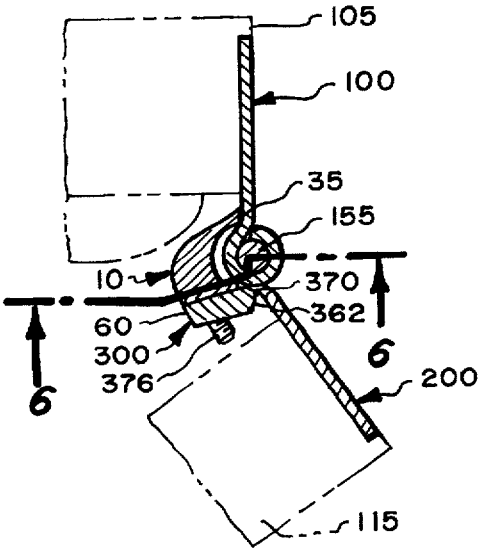
FIG. 5 is a transverse sectional view similar to FIGS. 3 and 4.
Figure 6:
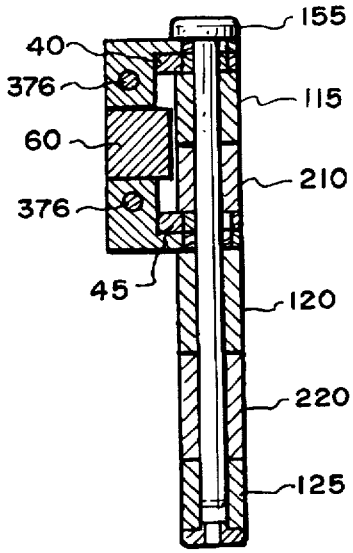
FIG. 6 is a vertical sectional view taken along the line 6—6 in FIG. 5.

FIGS. 1,3 and 4 show examples where the present invention comprises both the first and second stop elements mounted on the pair of door hinge leafs to limit the opening of the door. The curved arrow in FIG. 1 shows the direction in which the door swings open. The first and second stop elements in combination limit the opening of the door to about 120 degrees relative to its closed position in FIG. 1. The limitations are determined by the abutting edges or vertical faces 35 and 370 on the pair of stop elements 10 and 300.

The second stop element 300 is always used in combination with the first stop element 10. The first stop element, however, can be used without the second stop element 300. Just as the first stop element 10 has, the second stop element 300 also has a top portion 315, a bottom portion 320, a front portion 327, a back portion 330, a left side portion 335, and a right side portion 347. The second stop element 300 also has two components that are very similar to the top and bottom knuckles 40 and 45 in the first stop element 10. They are described as an axially aligned upper arm 340 and a spaced apart lower arm 345, each having hinge pin holes 350 and 355. Both arms are positioned at the top 315 and at the bottom 320 of the second stop element 300. Both arms define the length of the second stop element 300. The arms and the body of the second stop element can be described as an elongated U-shaped bracket. The distance between the inner surfaces of both arms 340 and 345 is the same as the distance between the outer surfaces of the two knuckles 40 and 45 on the first stop element 10 so that the first stop element 10 neatly fits inside the second stop element 300. The arms and knuckles are all in axial alignment with the barrels on the hinge leafs 100 and 200. This allows both stop elements 10 and 300 to freely pivot about the hinge pin 155, but both elements 10 and 300 can abut together to form one combination stop element such as is disclosed in FIGS. 1–5 in the drawings. The left vertical side 335 of the second stop element 300 is a flat surface with a transverse rectangular channel 360 for allowing clearance of the body of the vertical beveled head 60 on the first stop element 10 to allow the left side portion 335 of the second stop element 300 and the right side portion of the first stop element to meet flush with each other. This is clearly shown in FIG. 3. The back of the second stop element 300 has a longitudinal concave groove 362 running along the entire vertical length of the second stop element 300. The back 335 also has a narrow flat face 370 or edge for abutting against the active hinge 200. The front portion 327 of the second stop element has a vertical generally convex surface for avoiding contact with the face of a door 115 or wooden molding.

The first stop element can be installed on the door in the upright or inverted position. Additionally the combination of the first and second stop elements can also be installed in the upright or inverted position. The left and right side edges function interchangeably when stopping the door. Instructions will indicate the proper installation method. The installer, however, can make a mistake or not read the instructions. In this event the inverted mounting the elements will still allow the present invention to work properly.

The second stop element 300 contains a pair of adjustment screws 376 to adjust and limit the maximum angular opening of the door. FIG. 3 shows the adjustment screws threaded into the second stop element 300. FIG. 4 shows the adjustment screws partially extending from the left vertical side of the second stop element. The two adjustment screws cause the contact edges 35 and 370 of the stop elements 10 and 300 to pivot towards each to each other to reduce the gap in between the two. This pivoting is also clearly shown in FIG. 4. The net effect is to reduce and limit maximum angular rotation of the opening door. This adjustment feature allows the user to adjust the present invention to his or her desired limitation on the opening of the door to avoid damage to an adjacent wall or nearby furniture or appliances.

In employing the improved hinges and stop elements described above, they are fastened to the door and support frame in the usual manner either half mortise, full mortise, half surfaced or full surfaced and may be in the form of a left handed or right handed hinge as desired. The door is then swung to it desired limited open position, the adjustment screws 376 advanced into contact with the first stop element. The stop limiting position may be adjusted by merely loosening the adjustment screws 376 and repeating the above procedure. Furthermore, by removing the present invention stop member the hinge reverts to the conventional form.

Figure 11:
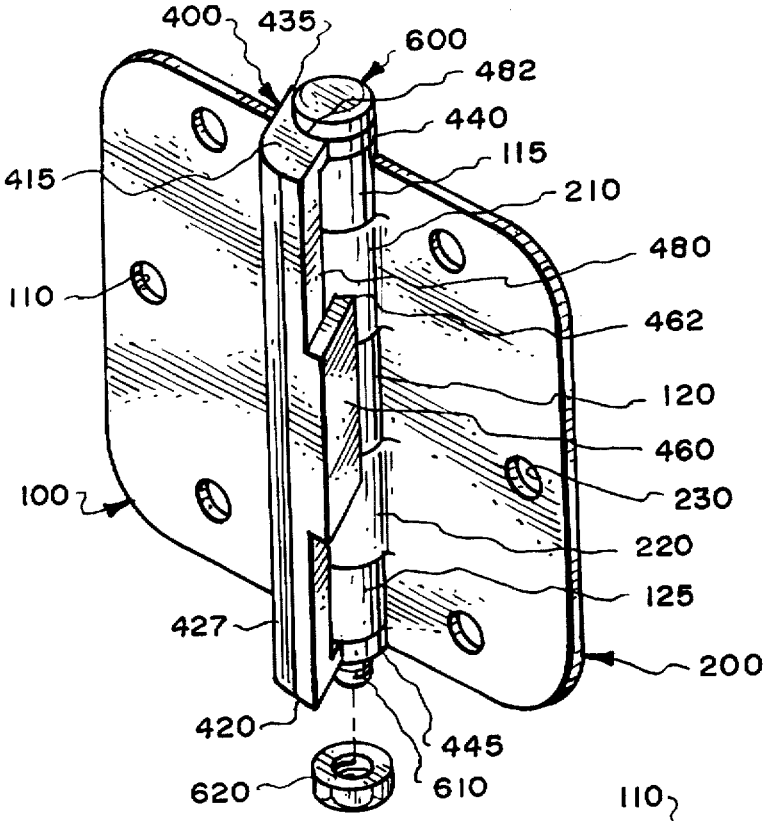
FIG. 11 is a perspective view of an elongated first stop element showing a variant of the present invention.
Figure 12:
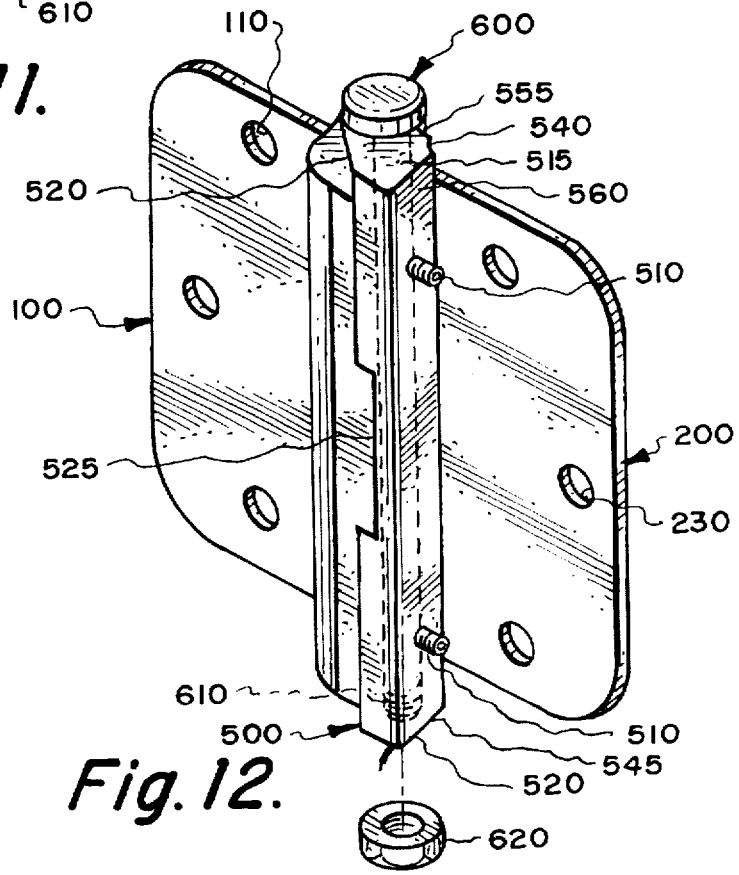
FIG. 12 is a perspective view similar to FIG. 11 with the addition of an elongated second stop element.

A variant of the present invention is illustrated in FIGS. 11 and 12. The first described invention as illustrated in FIGS. 1–10 requires a new or modified active hinge leaf. The barrel 210 has to have the bottom portion cutaway with a hacksaw to provide clearance for the bottom knuckle 45 of the first stop element 10 and/or the bottom arm 345 of the second stop element 300. The variant illustrated in FIGS. 11 and 12 is an elongated version of the previously described invention. This variant eliminates the need to modify a pair of conventional hinge leafs. The first elongated stop element 400 has a pair of axially aligned spaced apart upper and lower knuckles 440 and 445. Each knuckle has a hinge pin hole, which are not shown in FIGS. 11 and 12. Both knuckles 440 and 445 are positioned at the top 415 and the bottom 420 of the first stop element 400. Both knuckles can define the vertical length of the first stop element 400. The distance between the inner surface of the two knuckles is the same as or greater than the distance between the top and bottom of the barrels of the hinge leafs 100 and 200. This allows the elongated stop element to be slipped over a conventional pair of door leaf hinges. The first elongated stop element 400 has a generally transversely curved outer surface 427 for avoiding contact with any molding 121 adjacent a door jam where a stationary leaf hinge 100 can be mounted. The back of the first elongated stop element 400 has a concave cavity or recess for allowing clearance with the barrels on the active hinge leaf 200. The recess or concave cavity is not illustrated in FIGS. 11 and 12 but is similar to the recess shown in broken lines in FIG. 7 and is identical to the transverse sectional view of the first stop element 10 in FIG. 9. The left vertical side of the elongated first stop element 400 has a vertical narrow flat beveled face 435 for abutting against the stationary hinge adjacent stationary barrels 115 and 120 while still avoiding contact with the edge of the door jamb or any molding 120 adjacent a door jamb where the stationary leaf hinge 100 is mounted. The right side of the first stop element has an integral raised blade portion 460 that has the appearance of the end of a flat chisel blade with a beveled head 462 projecting from the back of the first elongate stop element 400 for abutting against the active hinge 480 adjacent knuckles 210 and 220. FIG. 9 illustrates the first stop element 10. This Figure also shows how the beveled head 462 can abut against the active hinge 480 near the knuckle, and the flat beveled face 435 can abut against the stationary hinge 482. The first elongated stop element 400 functions in this manner. It prevents the door 115 from opening beyond the 180 degree range.

The second elongated stop element 500 is always used in combination with the first elongated stop element 400. The first elongated stop element 400, however, can be used without the second elongated stop element 500. As does the first elongated stop element 400, the second elongated stop element 500 has a top 515, a bottom 520, a front, a back, a left vertical side, and a right vertical side. The second elongated stop element 500 also has two components that are very similar to the top and bottom knuckles 440 and 445 in the first elongated stop element 400. They are described as a pair of axially aligned spaced apart upper arm 540 and lower arm 545, each having hinge pin holes, which are not shown. Both arms are positioned at the top and at the bottom of the second elongated stop element 500. Both arms define the length of the second elongated stop element 500. The arms and the body of the second elongated stop element can be described as an elongated U-shaped bracket. The distance between the inner surfaces of both arms is the same as the distance between the outer surfaces of the two knuckles 440 445 on the first elongated stop element 400 so that the first elongated stop element 400 neatly fits inside the second elongated stop element 500. The arms and knuckles are all in axial alignment with the barrels on the hinge pin. This allows both stop elements 400 and 500 to freely pivot about the hinge pin 600, but can abut together to form one combination stop element such as is disclosed in FIGS. 11 and 12 in the drawings. The left side portion of the second elongated stop element 500 has a flat surface with a transverse rectangular channel 525 for allowing clearance of the body of the vertical beveled head 460 on the first elongated stop element 400 to allow the left side of the second elongated stop element 500 and the right side of the first elongated stop element 400 to meet flush with each other. This is clearly shown in FIG. 12. The back portion of the second elongated stop element 500 has a longitudinal concave groove 540 running along the entire vertical length of the second elongated stop element 500. To the left of the concave groove is a narrow vertical flat face 555 for abutting against the active hinge 200. The right side portion of the second elongated stop element 500 has a vertical convex surface 560 for avoiding contact with the face of a door 115 or wooden molding or trim. The second elongated stop element 500 contains a pair of adjustment screws 510 to adjust and limit the maximum angular opening of the door. The previous discussions regarding FIG. 4, which shows the adjustment screws partially extending from the face of the second stop element 300 also apply to the elongated second stop element 500. The two adjustment screws cause the contact points 435 and 555 of the stop elements 400 and 500 to pivot towards each to each other to reduce the gap in between the two. This pivoting is similar to that shown in FIG. 4. The net effect is to reduce and limit maximum angular rotation of the opened door. This adjustment feature allows the user to adjust the present invention to the desired limitation on the opening of the door to avoid damage to an adjacent wall, nearby furniture or appliances.

The nut 620 is threadably secured to the threaded end 610 of the hinge pin 600. The hinge pin is not a conventional hinge pin. It is longer and has the threaded end to secure the elongated version of the present invention to a convention pair of door hinge leafs.

The allen head screws 376 and 510 in the drawings preferably are longer than the thickness of either second stop element. The shaft and the head of the screw are the same thickness. The top has an allen indentation so that an allen head wrench of the proper size can turn the screw. The top of the screw can penetrate into the body of the second stop element when setting the maximum adjustment for the swinging door. This is shown in FIG. 4. The screw is lodged in the body of the second stop element and the tip of the adjustment screw is extending from the other side.

Obviously, many modifications and variants of the present invention are possible in light of the above teachings. It is therefore to be understood that the full scope of the invention is not limited to the details disclosed herein, but may be practiced otherwise than as specifically described.

What is claimed is:

1. A hinge mounted door stop for mounting to a modified conventional pair of door hinge leafs, which comprises:

a first stop element having a top, a bottom, a front, a back, a left side portion, and a right side portion;

a pair of axially aligned spaced apart upper and lower knuckles having pin holes and positioned at said top and said bottom of said first stop element and which define the length of said first stop element;

said front of said first stop element having a generally transversely curved outer surface for avoiding contact with any molding adjacent a door jam where a stationary leaf hinge is mounted;

said back of said first stop element being recessed for allowing clearance with a barrel on a hinge leaf;

said left side portion having a vertical narrow flat face for abutting against one hinge leaf while still avoiding contact with any molding adjacent a door jamb where one hinge leaf is mounted; and said right portion of said first stop element having a vertical beveled head projecting from said right side portion of said first stop element for abutting against the other hinge leaf.

2. A door stop as recited in claim 1 wherein the first stop element further comprises:

the modified pair of door hinge leafs comprising:

a pair of active and stationary hinge leafs having opposed vertical edges with a plurality of interdigitating axially aligned substantially cylindrical barrels along said opposed adjacent edges thereof;

said one of said cylindrical barrels being shorter than said other cylindrical barrels for allowing space for said lower knuckle on said first stop element to be placed in alignment with said cylindrical barrels when said first stop element is mounted to said pair of hinge leafs.

3. A door stop as recited in claim 1 further comprising:

a second stop element having a top, a bottom, a front, a back, a left side portion, and a right side portion;

a pair of axially aligned spaced apart upper and lower arms having pin holes and positioned at said top and said bottom of said second stop element and which define the length of said second stop element;

said left side portion of said second stop element having a flat face with a transverse rectangular channel for allowing clearance of said vertical beveled head on said first stop element;

said back of said second stop element having a longitudinal concave groove along the length of said second stop element;

said back of said second stop element having a narrow flat face for abutting against a hinge leaf; and at least one adjustment screw means for adjusting the maximum opening of a door to which the pair of door hinge leafs is mounted.

4. An elongated hinge mounted door stop for mounting to a conventional pair of door hinge leafs, which comprises:

a first elongated stop element having a top, a bottom, a front, a back, a left side portion, and a right side portion;

a pair of axially aligned spaced apart upper and lower knuckles having pin holes and positioned at said top and said bottom of said first elongated stop element and which define the length of said first elongated stop element;

said front of said first elongated stop element having a generally transversely curved outer surface for avoiding contact with any molding adjacent a door jam where a stationary leaf hinge is mounted;

said back of said first elongated stop element being recessed for allowing clearance with all the barrels on the conventional pair of door hinge leafs;

said left side portion having a vertical narrow flat face for abutting against one hinge leaf while still avoiding contact with any molding adjacent a door jamb where one hinge leaf is mounted; and said right portion of said first elongated stop element having a vertical beveled head projecting from said right side portion of said first elongated stop element for abutting against the other hinge leaf.

5. The elongated door stop as recited in claim 4 further comprising:

an elongated hinge pin having a length longer than the outer distance between said upper and lower knuckles for allowing said hinge pin to pivotally secure said first elongated stop element and the conventional pair of door hinge leafs;

removable means secured to the bottom of said hinge pin for maintaining said hinge pin in position during use.

6. A door stop as recited in claim 4 wherein the first elongated stop element comprises:

a second elongated stop element having a top, a bottom, a front, a back, a left side portion, and a right side portion;

a pair of axially aligned spaced apart upper and lower arms having pin holes and positioned at said top and said bottom of said second elongated stop element and which define the length of said second elongated stop element;

said left side portion of said second elongated stop element having a flat face with a transverse rectangular channel for allowing clearance of said vertical beveled head on said first elongated stop element;

said back of said second elongated stop element having a longitudinal concave groove along the length of said second elongated stop element;

said back of said second elongated stop element having a narrow flat face for abutting against a door hinge leaf; and at least one adjustment screw means for adjusting the maximum opening of a door to which the pair of conventional door hinge leafs is mounted.

7. A door stop as recited in claim 6 further comprising:

an elongated hinge pin having a length longer than the outer distance between said upper and lower arms of said second stop element for allowing said hinge pin to pivotally secure said first and second elongated stop elements and the conventional pair of door hinge leafs;

removable means secured to the bottom of said hinge pin for maintaining said hinge pin in position during use.

* * * * *